US010473096B2

(12) United States Patent
Calhoun et al.

(10) Patent No.: US 10,473,096 B2
(45) Date of Patent: Nov. 12, 2019

(54) MODULAR PUMP PLATFORM

(71) Applicant: AGILENT TECHNOLOGIES, INC., Loveland, CO (US)

(72) Inventors: John Calhoun, Lexington, MA (US); Vannie Yucong Lu, Billerica, MA (US); George Galica, Worcester, MA (US); Robert Langellotti, North Andover, MA (US); James Pierce, Waltham, MA (US)

(73) Assignee: Agilent Technologies, Inc., Santa Clara, CA (US)

( * ) Notice: Subject to any disclaimer, the term of this patent is extended or adjusted under 35 U.S.C. 154(b) by 887 days.

(21) Appl. No.: 13/832,004

(22) Filed: Mar. 15, 2013

(65) Prior Publication Data

US 2014/0271233 A1 Sep. 18, 2014

(51) Int. Cl.

| | |
|---|---|
| ***F04B 17/03*** | (2006.01) |
| ***F04B 39/14*** | (2006.01) |
| ***F04B 53/22*** | (2006.01) |
| ***F04B 23/04*** | (2006.01) |
| ***F04B 49/06*** | (2006.01) |

(Continued)

(52) U.S. Cl.

CPC ..... *F04B 17/03* (2013.01); *F01C 21/007* (2013.01); *F04B 23/04* (2013.01); *F04B 39/14* (2013.01); *F04B 49/06* (2013.01); *F04B 53/22* (2013.01); *F04C 18/0215* (2013.01); *F04C 25/02* (2013.01); *F04C 2240/70* (2013.01); *F04C 2240/81* (2013.01)

(58) Field of Classification Search

CPC ..... F04B 39/14; F04B 53/22; F04B 17/03; F04B 49/06; F04C 2240/70

USPC ..... 417/360, 238

See application file for complete search history.

(56) References Cited

U.S. PATENT DOCUMENTS

RE18,303 E * 12/1931 Harm ..... F04D 3/00 415/221
1,902,076 A * 3/1933 Jaworowski ..... F04C 2/32 418/214

(Continued)

FOREIGN PATENT DOCUMENTS

JP 2006029238 A * 2/2006

OTHER PUBLICATIONS

Machine Translation of JP 2006-029238.*

(Continued)

*Primary Examiner* — Christopher S Bobish

(57) ABSTRACT

A modular pump platform includes a pump head module, a pump motor module, an electronics module and a separable tray. The pump motor module includes a pump motor having a rotary output removably coupled to a crank shaft of the pump head, the pump motor being one of multiple types of pump motors, and the pump motor module being detachably connected to the pump head module. The electronics module includes an electronic control circuit configured to control operation of the pump motor, the electronic control circuit being one of multiple types of electronic control circuits corresponding to the types of pump motors. Each of the pump head module, the pump motor module and the electronics module is detachably connected to the separable tray. At least the pump motor module is interchangeable with another pump motor module comprising a pump motor of another type.

16 Claims, 9 Drawing Sheets

(51) Int. Cl.

| | |
|---|---|
| ***F01C 21/00*** | (2006.01) |
| ***F04C 25/02*** | (2006.01) |
| ***F04C 18/02*** | (2006.01) |

(56) References Cited

U.S. PATENT DOCUMENTS 3,681,919 A * 8/1972 Forster ..... F16H 57/033 417/238
3,817,664 A * 6/1974 Bennett ..... F01C 1/0215 418/55.1
4,123,201 A * 10/1978 Andriulis ..... F04C 18/3441 417/204
4,302,160 A * 11/1981 Hofmann, Jr. ..... F04B 39/0033 417/313
4,354,655 A * 10/1982 Hengst ..... F16M 7/00 248/676
4,471,898 A * 9/1984 Parker ..... H05K 7/1427 220/23.4
4,516,657 A * 5/1985 Allard ..... F02B 63/04 181/204
4,523,897 A * 6/1985 Lower ..... F01C 21/0809 417/244
4,588,358 A * 5/1986 Rietschle ..... F04C 23/001 417/247
5,040,953 A * 8/1991 Tinsler ..... F16F 1/377 248/632
5,110,082 A * 5/1992 Rowan, Jr. ..... F16M 7/00 248/649
5,360,322 A * 11/1994 Henein ..... B60G 17/0152 417/313
5,626,467 A * 5/1997 Cantley ..... F01L 23/00 417/312
5,767,606 A * 6/1998 Bresolin ..... F04D 13/06 310/162
5,961,293 A * 10/1999 Clemmons ..... F02M 37/10 417/410.4
6,447,264 B1 * 9/2002 Lucas ..... F04B 39/0033 417/201
6,450,782 B1 * 9/2002 Sakamoto ..... F04C 23/00 248/678
6,491,494 B1 * 12/2002 Beckenbach ..... F01P 5/12 415/206
6,726,065 B2 * 4/2004 Sanders ..... G01F 11/22 222/333
6,790,012 B2 * 9/2004 Sharp ..... F04B 39/0033 181/198
7,028,970 B1 * 4/2006 Wiseman ..... F16M 5/00 108/51.11
7,074,017 B2 * 7/2006 Coray ..... F04D 13/021 29/888.021
7,413,411 B2 * 8/2008 Gaudet ..... F04B 37/08 417/423.4
7,490,697 B1 * 2/2009 Williamson, Jr. ..... B60P 3/36 181/200
7,614,855 B2 * 11/2009 Cook ..... F04B 17/03 264/674
8,608,453 B2 * 12/2013 Paluncic ..... F16N 13/02 417/238
8,757,918 B2 * 6/2014 Ramnarain ..... F04B 17/03 248/678
2005/0254970 A1 * 11/2005 Mayer ..... F04C 2/086 417/410.4
2008/0058146 A1 * 3/2008 Pizzichil ..... F04D 13/022 475/72
2009/0162216 A1 6/2009 Paluncic
2011/0142536 A1 6/2011 Ramnarain et al.
2011/0189036 A1 * 8/2011 Long ..... B23P 6/00 417/423.12
2012/0060547 A1 * 3/2012 Fujisue ..... F04B 35/04 62/498
2012/0227847 A1 * 9/2012 Mohamed ..... F01L 3/205 137/855
2014/0134034 A1 * 5/2014 Nakamura ..... F01C 13/04 418/55.3

OTHER PUBLICATIONS

Machine Translation of JP 2006-29238.*
UK Search Report dated Oct. 10, 2014.
Chinese Office Action with English translation dated May 27, 2014.
Co-pending U.S. Appl. No. 13/853,655, filed Mar. 29, 2013.
Co-pending U.S. Appl. No. 13/800,028, filed Mar. 13, 2013.
GB Examination report issued in counterpart GB Application No. GB1402616.5 dated Jul. 1, 2019 (six (6) pages).

* cited by examiner

MODULAR PUMP PLATFORM

BACKGROUND

Conventional vacuum pumps are generally provided to customers with integrated components, such as a fixed pump head/motor assembly and corresponding electronics. The integrated components are not designed to be interchangeable with other types of components, and therefore any variations to the vacuum pump are generally very difficult or not possible to implement without significant effort.

For example, a vacuum pump may include a pump head operated by a permanently affixed single phase motor and corresponding control electronics. The pump head and motor are integrated within a housing designed specifically to accommodate the particular combination. Use of another type of pump motor, such as a inverter controlled variable speed three phase motor or a DC motor, is not an option. For example, the pump head may not be able to physically couple to the pump motor and/or the electronics may be incompatible. Likewise, the physical space within the housing may be too small or too large to accommodate the inverter controlled variable speed three phase motor.

In the vacuum pump market, it is desirable to have a variably configurable or modular pump platform in order to meet different application requirements, cost targets, country specific voltage requirements, and similar variable criteria. For example, it is desirable to have a separable and modular pump head that may be driven by multiple modular pump motor options, including a single phase motor and inverter controlled variable speed three phase motor, for example. It is also desirable to have separable and modular electronics for driving the different pump motors (and other modular components). In hazardous environments or applications sensitive to electromagnetic fields, it is desirable to have a vacuum pump that can be driven by non-electrical means, such as an air or hydraulically driven motor.

SUMMARY

According to an aspect of the present invention, a modular pump platform includes a pump head module comprising a pump head having a stationary portion and a rotary portion connected to a crank shaft; a pump motor module comprising a pump motor having a rotary output removably coupled to the crank shaft of the pump head, the pump motor being one of a plurality of types of pump motors, and the pump motor module being detachably connected to the pump head module; an electronics module comprising an electronic control circuit configured to control operation of the pump motor, the electronic control circuit being one of a plurality of types of electronic control circuits corresponding to the plurality of types of pump motors; and a separable tray to which each of the pump head module, the pump motor module and the electronics module corresponding to the pump motor module is detachably connected. At least the pump motor module is interchangeable with another pump motor module comprising a pump motor of another type of the plurality of types of pump motors.

According to another aspect of the present invention, a modular pump platform includes a separable tray; a pump head module detachably connected to the separable tray; a pump motor module detachably connected the pump head module and the separable tray; and an electronics module detachably connected to the separable tray and the pump motor module. The pump motor module is configured to include a plurality of different types of pump motors for operating the pump head module. The electronics module is configured to include a plurality of different electronic control circuits corresponding to the plurality of different types of pump motors.

BRIEF DESCRIPTION OF THE DRAWINGS

These and other objects, features and advantages of the present invention will be better understood from the detailed description of the preferred embodiments thereof that follows with reference to the accompanying drawings.

DETAILED DESCRIPTION

Figure 1:
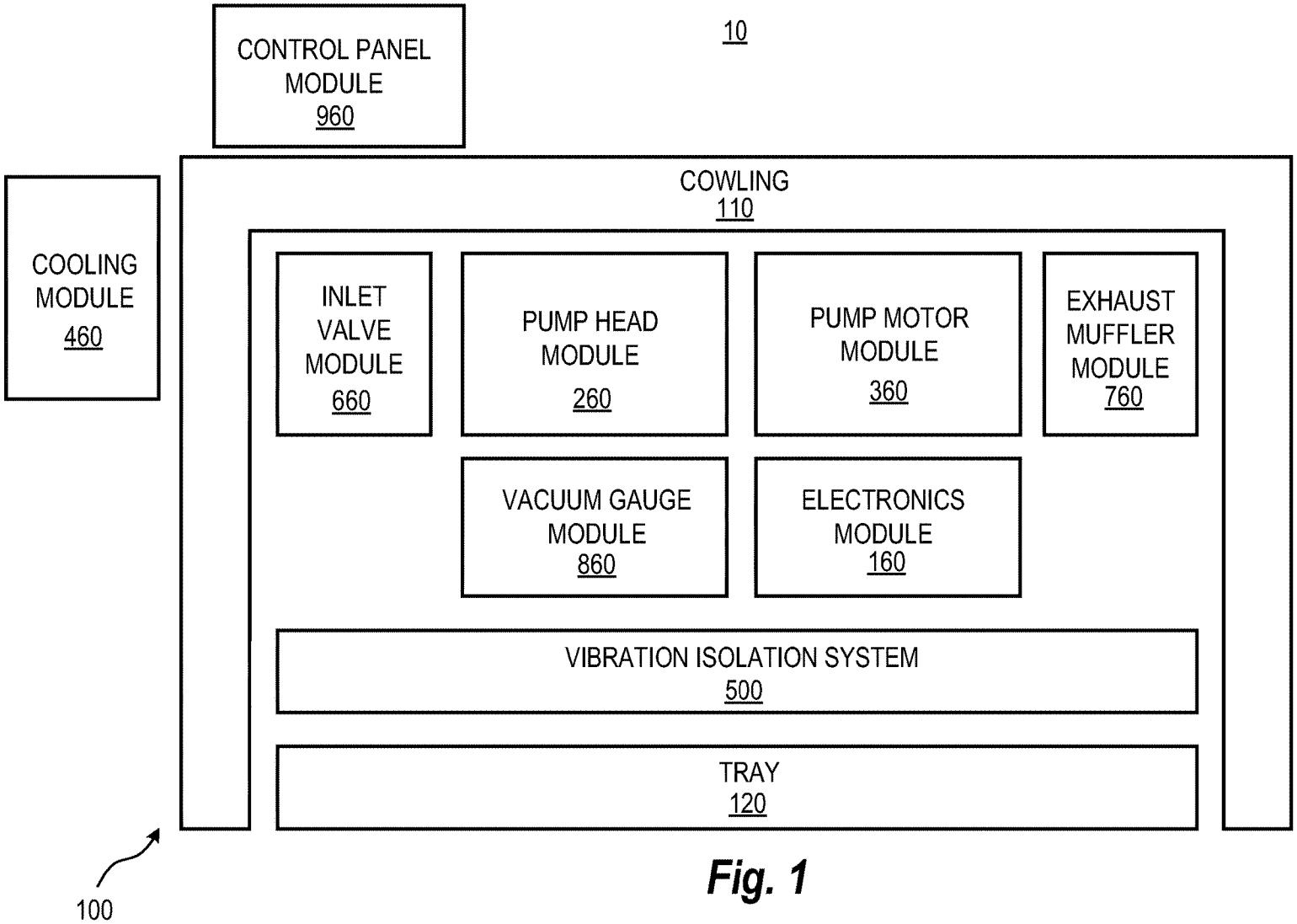
FIG. 1 is a block diagram of a modular pump platform, according to a representative embodiment.

Various embodiments and examples of embodiments of the inventive concept will be described more fully hereinafter with reference to the accompanying drawings. In the drawings, the sizes and relative sizes of elements may be exaggerated for clarity. Likewise, the shapes of elements may be exaggerated and/or simplified for clarity and ease of understanding. Also, like numerals and reference characters are used to designate like elements throughout the drawings.

Furthermore, terminology used herein for the purpose of describing particular examples or embodiments of the inventive concept is to be taken in context. For example, the term "comprises" or "comprising" when used in this specification indicates the presence of stated features or processes but does not preclude the presence of additional features or processes. The term "pump" may refer to apparatus that drives, or raises or decreases the pressure of, a fluid, etc. The term "fixed" may be used to describe a direct connection of two parts to one another in such a way that the parts can/do not move relative to one another or a connection of the parts through the intermediary of one or more additional parts in such a way that the parts can/do not move relative to each other. The terms "detachably connectable" or "detachably connected" may be used to describe a non-permanent yet secure mechanical and/or electrical connection between components, where the connection is easily engaged and disengaged, e.g., by hand (without the use of tools) or using relatively simple tools such as a screw driver or a wrench. For example, components held together by screw fasteners, bolt fasteners, bayonet mounts, a flange joint and at least one pilot feature for alignment, plugs and sockets, press-fits, shrink-fits, and the like, may be considered "detachably connected" to one another, whereas components molded or integrally formed together or held together by solder, welds, rivets, and the like, may not be considered "detachably connected" to one another.

Various embodiments generally relate to a modular pump platform having interchangeable modules, such as a pump head module, a pump motor module and an electronics module, that are easily combined and separated from one another to enable efficient assembly, customization and replacement. For example, the pump motor may be modularized into a separable pump motor module, and the motor control electronics may be modularized into a separable electronics module, both of which are detachably connectable to a separable tray. Thus, a vacuum pump, for example, will have modularity in the choice of motor and electronics types and configurations, as well as integrating other functions onto the electronics circuit board, such as fan speed control, power supply for cooling fans and isolation inlet valves, inlet valve operational control, and the like.

FIG. 1 is a block diagram of a modular pump platform, according to a representative embodiment.

Referring to FIG. 1, modular pump platform 10 incorporates its various systems as separable modules. The modular pump platform 10 includes major systems, such as pump head module 260, pump motor module 360 and electronics module 160, which are detachably connectable to one another and/or to a separable tray 120. The modular pump platform 10 may further include one or more additional systems in modular form. For example, in the depicted embodiment, the modular pump platform 10 further includes cooling module 460, vibration isolation system 500, inlet valve module 660, exhaust muffler module 760, vacuum gauge module 860 and control panel module 960.

All or a portion of the modules may be connected to and/or housed within removable housing or sound-muffling enclosure 100, which includes a separable cowling 110 and the separable tray 120. The sound-muffling enclosure 100 is configured to accommodate predetermined sizes and shapes of modules and corresponding connectors, so that the modules are interchangeable with other like modules. For example, a pump motor module 360 that includes a single phase motor is substantially the same size and has the same connectors as a pump motor module 360 that includes a inverter controlled variable speed three phase motor, so that the two pump motor modules 360 are interchangeable. That is, the pump motor module 360 may be inserted into the same space and connected to the sound-muffling enclosure 100 and/or the pump head module 260 using the same connectors regardless of the type of motor the pump motor module 360 contains. The same is true for the other modules, as well.

In certain cases, it may be desirable to have a modular pump platform 10 with no cowling 110. For example, the cowling 110 may be excluded when the space inside a machine cabinet is limited and a stream of cooling air can be supplied from some other source. Accordingly, the pump head module 260 and the pump motor module 360 may be operated sitting on the tray 120, without the cowling 110. Also, by modifying the wiring harnesses, all or part of the electronics module 160 may be located remotely from the pump head module 260 and the pump motor module 360, and the tray 120 may also be excluded.

The pump head module 260 may include a vacuum pump head, for example, such as a scroll pump that includes a stationary plate scroll having a stationary scroll blade, and an orbiting plate scroll having a scroll blade nested with the stationary scroll blade, as discussed below. Of course, other types of pump heads may be included in the pump head module 260 without departing from the scope of the present teachings. For example, pump heads having scroll sets designed for higher or lower displacements, with corresponding increases and decreases in ultimate vacuum pressure, respectively, may be included.

The pump motor module 360 includes a pump motor having a rotary output coupled to a pumping mechanism (e.g., an orbiting plate scroll interfacing with a stationary plate scroll, so as to drive the orbiting scroll blade relative to the stationary scroll blade). The pump motor module 360 may include any of various different types of pump motors, including a single phase motor, an inverter controlled variable speed three phase motor, a brushless DC motor, a brushed DC motor, all varieties of induction, repulsion, shaded-pole and universal AC motors, air power motors and hydraulically driven motors, for example. The different types of pump motors may operate at different voltages.

In an embodiment, each type of motor that may be included in the pump motor module 360 and each type of pump head that may be included in the pump head module 260 is fitted with a universal coupler to enable communication between any motor and any pump head. For example, the pump head may include a first end of the universal coupler attached to a pump head input shaft, and the pump motor may include a second end of the universal coupler attached to a motor output shaft, the first and second ends of the universal coupler being configured to interconnect for translating rotary output of the motor output shaft to the pump head input shaft.

For example, the universal coupler may comprise a male connector protruding from the motor output shaft and a female connector formed in the pump head input shaft and configured to join the male connector. Alternatively, the universal coupler may comprise a joint having opposing female connectors, where male connectors protruding from both the motor output shaft and the pump head input shaft are configured to join the opposing female connectors, respectively. Of course, in the various embodiments described above, the locations of the male and female connectors may be reversed, without departing from the scope of the present teachings.

In addition, the pump head module 260 and the pump motor module 360 have the same connectors for connecting to one another regardless of the type of pump head and pump motor that they contain, respectively. For example, the pump motor module 360 may be detachably connected to the pump head module 260 by a series of bolts extending through holes aligned in flanges extending from the pump motor module 360 and the pump head module 260, respectively. The sizes and locations of the flanges and aligned holes are the same regardless of the type of motor in the pump motor module 360 and the type of pump head in the pump head module 260, thus enabling the interchangeability among the different types of pump motor modules 360 and pump head modules 260.

Of course, other types of removable attachments may be incorporated without departing from the scope of the present teachings. For example, the pump motor module 360 may have one or more bayonet mounts configured to communicate with corresponding receiving portion(s) in the pump head module 260, where the pump motor module 360 is secured by performing a quarter turn of the pump motor module 360 with respect to the pump head module 260. A bayonet mount may be desirable in that it enables manual quick release functionality for greater ease in exchanging or changing out the different types of pump motor modules 360 and pump head modules 260. It is understood that the various types of connectors may be used for interconnecting any of the modules of the modular pump platform 10 to adjacent modules, as needed.

The electronics module 160 provides electronics, including a power source, corresponding to the pump motor module 360. However, in various configurations, the electronics module 160 may also contain electronics corresponding to one or more other modules, such as the cooling module 460, the inlet valve module 660, vacuum gauge module 860 and control panel module 960. The electronics module 160 may include a printed circuit board and electrical connectors designed for the particular type of motor in the pump motor module 360.

In various embodiments, the electronics module 160 may be dedicated to the type of pump motor, or one electronics module 160 may correspond to multiple types of pump motors. To the extent the electronics module 160 corresponds to multiple types of pump motors, the electronics module 160 does not necessarily need to be changed out whenever a different type of pump motor module 360 is attached. The electronics module 160 also includes electrical connectors, such as wiring harnesses and plugs/sockets, for connecting to the pump motor module 360 and for connecting to an external power source. Electronic filters, voltage rectifiers, voltage regulators, transformers, fuses and the like may also be included in the electronics module 160, as would be apparent to one skilled in the art.

In an embodiment, the electronics module 160 is detachably connectable to the tray 120. For example, the electronics module 160 may be detachably connected using screw or bolt fasteners, or the electronics module 160 may press-fit into pre-formed sockets or the like, or printed circuit board 165 of the electronics module 160 may be fit into corresponding slots on the tray 120. In alternative embodiments, the electronics module 160 and the tray 120 may be one integrated piece that is changed as a unit based on the type of motor in the pump motor module 360.

As mentioned above, according to various embodiments, electrical components for the pump motor module 360 and other modules, such as the cooling module 460, the inlet valve module 660, the vacuum gauge module 860 and the control panel module 960, may be combined onto a single printed circuit board of the electronics module 160. For example, a single phase split phase induction motor requires start and run capacitors, a start switch and other electrical components required for its operation, which may be combined onto a single circuit board, such as printed circuit board 165 discussed below with reference to FIG. 2, with electrical components of other modules. Such electrical components may include power supply and fan speed control circuit for a cooling fan of the cooling module 460, power supply and valve control circuit for isolation inlet valve(s) of the inlet valve module 660, and various interconnections. This reduces complexity of the wiring harnesses, for example, and permits easy connection to components not mounted on the circuit board, such as the start and run capacitors, the cooling fan, the isolation inlet valve, and the like.

Notably, with respect to a single phase motor, the electronics module 160 includes one or two capacitors for operation. Due to large size, the capacitor(s) may or may not be located directly on the printed circuit board 165. However, the capacitor(s) are still integral to the electronics module 160, regardless of whether they are physically hard-mounted to the printed circuit board. With respect to a variable speed three phase motor, the electronics module 160 includes a DC power supply and inverter, along with controlling firmware, for example. To enhance flexibility, at least two versions of the electronics module 160 may exist for one variable speed three phase motor, one of which has more advanced functions, such as electronics for operating a control panel module 960, or controlling the function of the pump according to the reading of a vacuum gauge.

The cooling module 460 may include a cooling fan, for example, such as cooling fan 400 discussed below with reference to FIG. 4. The cooling module 460 is detachably connected to the cowling 110 of the sound-muffling enclosure 100 in the vicinity of an air inlet, such as air inlet 100A discussed below with reference to FIG. 2. The cooling module 460 may include various types, sizes and/or speeds of cooling fans that are appropriate for different types of pump heads and/or pump motors. Electronics for operating the cooling fan, such as a thermostat, a speed controller, and a power supply, may be included in the electronics module 160, as discussed above, or may be part of the cooling module 460. The cooling module 460 may be detachably connected to the cowling 110 using screw or bolt fasteners, for example.

The vibration isolation system 500 supports the pump head module 260 and the pump motor module 360, and includes a set of vibration isolators for reducing the transmission of vibrations. The vibration isolation system 500 may be detachably connected on one side to the assembled pump head module 260 and the pump motor module 360, and on an opposite side to the tray 120, making the vibration isolation system 500 easily removable. Also, vibration isolators may be used between the tray 120 and the pumping mechanism of the pump head, so that the pump head module 260 may be moved and handled as a single assembly, without requiring customer installation of vibration isolators, or risking damage to the isolators.

The inlet valve module 660 includes an isolation inlet valve, which may be one of various types of isolation inlet valves. For example, inlet valve module 660 may include a vacuum actuated valve (air operated inlet valve), an electrically actuated valve (fully sealed inlet valve), or a straight through fitting. The inlet valve module 660 is detachably connected to the pump head module 260 within the sound-muffling enclosure 100, for example, between the cooling module 460 and an inlet portion of the pump head module 260. Electronics for operating the inlet valve, particularly in the case of an electrically actuated valve, such as a valve operational controller and a power supply, may be included in the electronics module 160, as discussed above, or may be part of the inlet valve module 660. The inlet valve module 660 may be detachably connected to the pump head module 260 using screw or bolt fasteners, for example. In alternative embodiments, the body of the inlet valve module 660 may be threaded into the cowling 110, or attached by a bayonet mount. In various embodiments, an inlet valve may not be required or desired for the pump head, in which case the modular pump platform 10 does not include an inlet valve module 660 or the inlet valve module 660 includes the straight through fitting, which provides pass through to the inlet of the pump head.

The exhaust muffler module 760 includes a system that muffles noise produced by the assembled pump head module 260 and pump motor module 360. The exhaust muffler module 760 may be detachably connected to the pump head module 260 and the tray 120. The exhaust muffler module 760 generally includes an exhaust muffler, connected between an interior exhaust fitting in the pump head module 260 and exterior exhaust fitting via interconnected tubing, to reduce noise created by operation of the pump head module 260 and the pump motor module 360, as discussed below with reference to FIG. 5. The exhaust muffler of the exhaust muffler module 760, in particular, may be detachably connected to the tray 120 using screw or bolt fasteners, for example.

The vacuum gauge module 860 includes a vacuum gauge for indicating the pressure in the pump head of the pump head module 260 detected by a sensor. The vacuum gauge module 860 is detachably connected to a vacuum side/inlet area of the pump head in the pump head module 260. The vacuum gauge module 860 may be detachably connected to a wall of the pump head in the vacuum area of the pump head module 260 by various means, while the sensor for the vacuum gauge is insertable in the wall to sense pressure within the pump head, as discussed below with reference to FIGS. 6A-6E. Different types of vacuum gauges may be incorporated, such as a thermocouple vacuum gauge, a capacitance manometer, a Pirani gauge, and gauges that combine multiple sensor types to cover a wider range, for example. Electronics for operating the vacuum gauge module 860 may be included in the electronics module 160, as discussed above, or may be contained in the vacuum gauge module 860.

The control panel module 960 includes an external control panel that provides a user interface. The control panel module 960 may include a display, a keyboard, a touch screen, and/or other features that enable control and monitoring of the modular pump platform 10 by the user. The control panel module 960 may be detachably connected to the cowling 110 of the sound-muffling enclosure 100 using screw or bolt fasteners, or the control panel module 960 may press-fit or snap-fit into pre-formed holes, where the holes are sealable using plugs when the control panel module 960 is not in place, as discussed below with reference to FIGS. 7A and 7B. Electronics for operating the control panel module 960 may be included in the electronics module 160, as discussed above, or may be contained in the control panel module 960.

Figure 2:
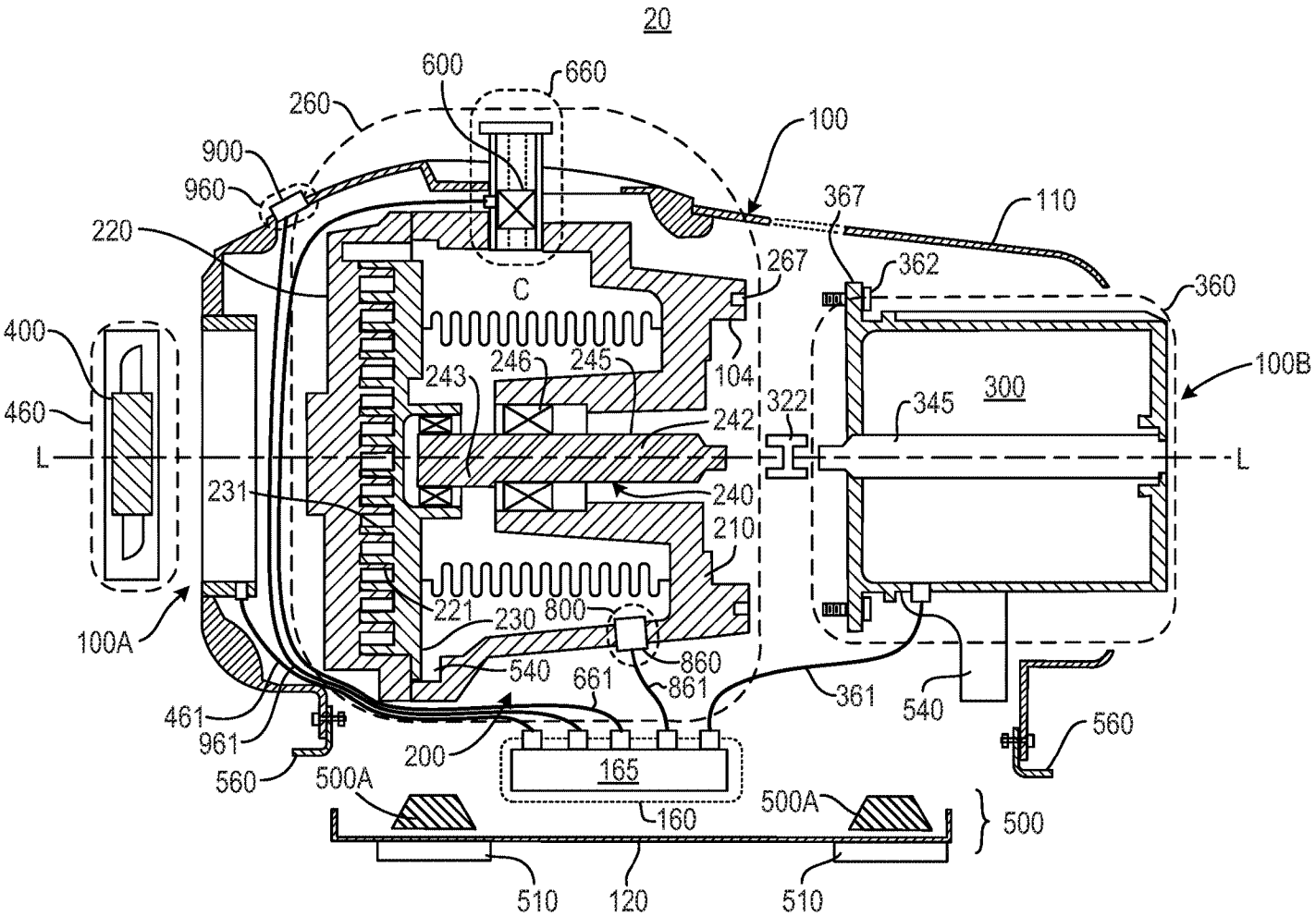
FIG. 2 is an exploded view of a schematic longitudinal section of a modular pump platform including a scroll pump, according to a representative embodiment.

FIG. 2 is an exploded view of a schematic longitudinal section of a modular pump platform including a scroll pump, according to a representative embodiment.

Generally, a scroll pump is a type of vacuum pump that includes a stationary plate scroll having a stationary plate and a spiral stationary scroll blade projecting axially therefrom, and an orbiting plate scroll having an orbiting plate and a spiral orbiting scroll blade projecting axially therefrom. The stationary and orbiting scroll blades are nested with a clearance and predetermined relative angular positioning such that a pocket (or pockets) is delimited by and between the stationary and orbiting scroll blades. The stationary plate scroll is fixed in the pump. The orbiting plate scroll and hence, the orbiting scroll blade, is coupled to an eccentric driving mechanism. The stationary and orbiting plate scrolls and the eccentric drive mechanism may make up the pump head.

The eccentric drive mechanism is, in turn, connected to and driven by a pump motor such that the orbiting plate scroll orbits about a longitudinal axis of the scroll pump passing through an axially central portion of the stationary scroll blade. The volume of the pocket(s) delimited by the scroll blades of the scroll pump is varied as the orbiting scroll blade moves relative to the stationary scroll blade. The orbiting motion of the orbiting scroll blade also causes the pocket(s) to move within the scroll pump head assembly such that the pocket(s) is selectively placed in open communication with an inlet and outlet of the scroll pump.

In an example of such a scroll pump, the motion of the orbiting scroll blade relative to the stationary scroll blade causes a pocket sealed off from the outlet of the scroll pump and in open communication with the inlet of the scroll pump to expand. Accordingly, fluid is drawn into the pocket through the inlet. Then the pocket is moved to a position at which it is sealed off from the inlet of the scroll pump and is in open communication with the outlet of the scroll pump, and at the same time the pocket is collapsed. Thus, the fluid in the pocket is compressed and thereby discharged through the outlet of the scroll pump.

In the case of a vacuum-type of scroll pump, the inlet is connected to a chamber that is to be evacuated. Conversely, in the case of a compressor-type of scroll pump, the outlet is connected to a chamber that is to be supplied with pressurized fluid by the pump.

Referring to FIG. 2, illustrative modular pump platform 20 is a scroll pump. The modular pump platform 20 includes a sound-muffling enclosure 100, comprising the tray 120 and the cowling 110, which is shown artificially segmented in FIG. 2 for purposes of illustration. Within the sound-muffling enclosure 100, the modular pump platform 20 further includes the pump head module 260, including pump head 200, the pump motor module 360, including pump motor 300, and the electronics module 160. The pump head module 260 and the pump motor module 360 respectively include (scroll) pump head 200 and pump motor 300. The electronics module 160 corresponds to the type of pump motor 300 contained in the pump motor module 360, and includes printed circuit board 165 and motor wiring harness 361. The pump motor 300 thus is electrically connected to the printed circuit board 165 for operation and control via the motor wiring harness 361 and a detachable plug. Each of the pump head module 260, the pump motor module 360 and the electronics module 160 is detachably connectable to the tray 120.

Figure 3A:
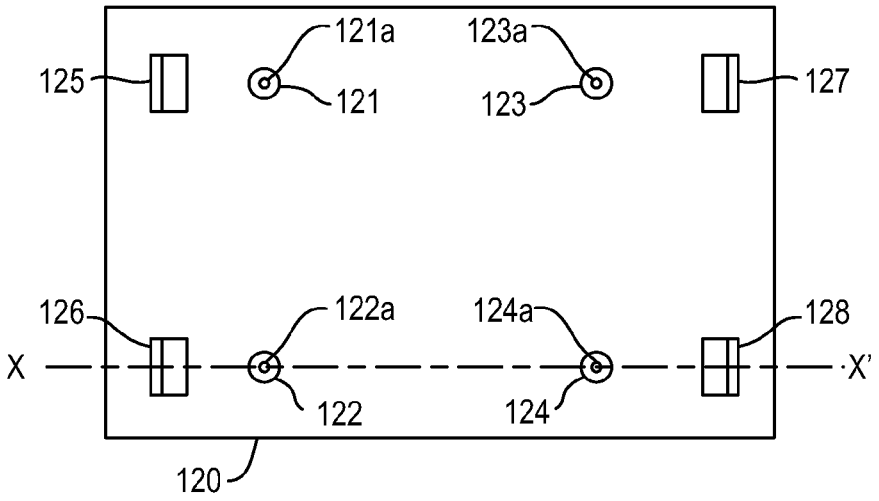
FIG. 3A is a top plan view of a top surface of a tray showing a press-fit connector for a printed circuit board, according to a representative embodiment.
Figure 3B:
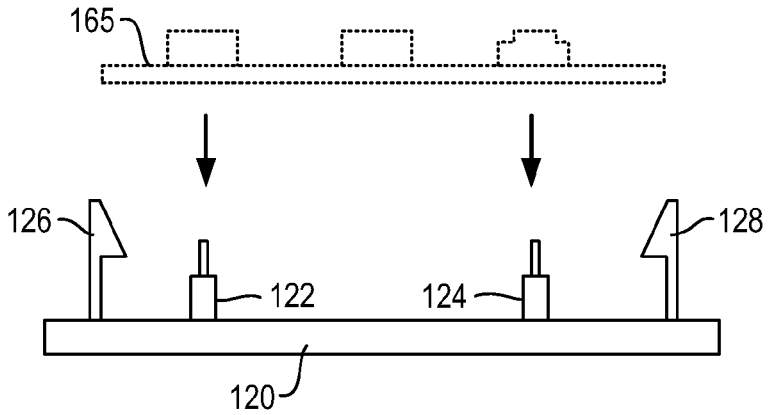
FIG. 3B is a cross-section view of the tray shown in FIG. 3A with the printed circuit board in a disassembled state, according to a representative embodiment.
Figure 3C:
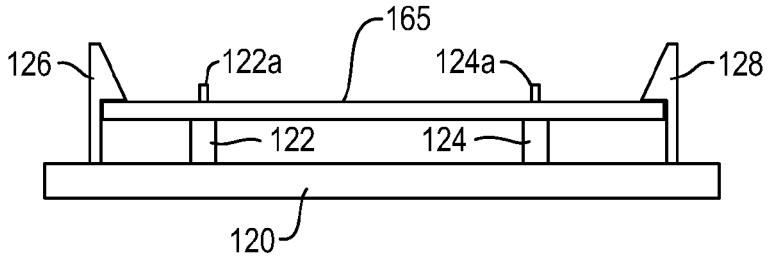
FIG. 3C is a cross-section view of the tray shown in FIG. 3A with the printed circuit board in the assembled state, according to a representative embodiment.

FIGS. 3A to 3C depict an illustrative configuration of the printed circuit board 165 being detachably connectable to the tray 120 using a press-fit connector. FIG. 3A is a top plan view of a top surface of the tray 120, which includes locating pins 121 to 124 and flexible snap fit retainers 125 to 128 extending from the top surface of the tray 120. The locating pins 121 to 124 include protruding portions 121*a* to 124*a*, respectively, which are configured to communicate with (e.g., extend through) corresponding holes in the printed circuit board 165. FIG. 3B is a cross-section view of the tray 120 taken along line X-X' with the printed circuit board 165 in the disassembled state, showing the locating pins 122 and 124 and the flexible snap fit retainers 126 and 128. The printed circuit board 165 (which may include various components) is shown above the tray 120, prior to assembly. FIG. 3C is another cross-section view of the tray 120 taken along line X-X' with the printed circuit board 165 in the assembled state. The protruding portions of 122*a* and 124*a* are inserted through the corresponding holes in the printed circuit board 165, such that the printed circuit board 165 rests on shoulders of the locating pins 122 and 124. The flexible snap fit retainers 126 and 128, which flex outwardly as the printed circuit board 165 is pressed in place along sloped inner edges of the flexible snap fit retainers 126 and 128, are shown after they have returned to their original (unflexed) positions to retain the printed circuit board 165. The printed circuit board 165 is thus held in place by lips formed at the bottoms of the sloped edges.

As mentioned above, all types of pump motor module 360 have similar mounting provisions for connecting with the pump head module 260. For example, referring to FIG. 2 the pump head module 260 may include flange 267 and the pump motor module 360 may include flange 367. Each of the flanges 267 and 367 define complementary holes that align with one another, enabling connection between the flanges 267 and 367 using bolts 362. This connection provides alignment of input shaft 245 of the pump head 200 and output shaft 345 of the pump motor 300 at pilot diameter 104, and connecting the input shaft 245 and the output shaft 345 shafts at universal coupling 322. Of course, alternative connections may be incorporated. For example, the pump motor module 360 may be connected to the pump head module 260 by a bayonet type mount, where installation and removal are effected by a twisting motion.

The cooling module 460, which includes cooling fan 400 and fan wiring harness 461, is detachably connectable to the cowling 110 in close proximity to air inlet 100A. In the depicted embodiment, the printed circuit board 165 includes electronic circuitry for operating the cooling fan 400, which is electrically connected to the printed circuit board 165 via fan wiring harness 461 and a detachable plug. In alternative embodiments, the electronic circuitry may be included in the cooling module 460 or on a printed circuit board detachably connected to the tray 120 other than the printed circuit board 165.

Figure 4:
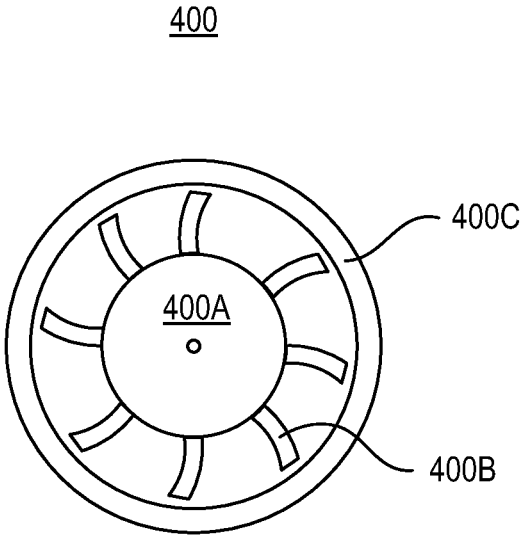
FIG. 4 is a schematic cross-sectional view of a cooling fan of a cooling module, according to a representative embodiment.

FIG. 4 is a schematic cross-sectional view of a cooling fan of the cooling module 460, according to a representative embodiment. Referring to FIG. 4, the cooling fan 400 has a fan hub 400A, fan blades 400B radiating from the hub, a fan housing 400C having an inner surface surrounding tips of the fan blades 400B, and a variable speed fan motor (not shown in the figure) connected to the fan hub 400A. The cross-sectional area of the space defined by and between the inner peripheral surface of the fan housing 400C and the outer peripheral space of the fan hub 400A, at the downstream end of the fan housing 400C, may be substantially the same as the maximal cross-sectional area of a cooling tunnel (not shown) circumferentially surrounding the pump motor 300, namely, of the space defined by and between an inner peripheral surface of the cowling 110 and an outer peripheral surface of the pump motor 300. Note, in this respect, the respective inner and outer peripheral surfaces of the cowling 110 and the pump motor 300 may be substantially cylindrical, so that the cross-sectional area of the cooling tunnel is substantially uniform along its entire length. An example of a cooling system including a cooling tunnel is described in U.S. Patent Application Pub. No. US 2014/0294623, titled "Thermal/Noise Management in a Scroll Pump," which is hereby incorporated by reference.

The airflow area of the cooling tunnel may be greater or less than that of the cooling fan 400 to optimize the cooling of the pump motor 300. For a given output of the cooling fan 400, the greater the airflow area of the cooling tunnel becomes, the greater is the volume of air that is displaced through cooling tunnel per unit time, but the lower is the heat transfer coefficient at the boundary between the pump motor 300 and the airflow. The opposite effect occurs the smaller the airflow area of the cooling tunnel becomes.

In the embodiment depicted in FIG. 2, the vibration isolation system 500 is included to separate the assembled pump head module 260 and pump motor module 360 from the tray 120, and further to separate the tray 120 from a support surface (not shown). The vibration isolation system 500 includes a set of vibration isolators 500A and a set of feet 510, each having top and bottom ends. The vibration isolators 500A may be elastic for reducing transmission of vibration of the modular pump platform 20 to a support structure and/or solid for otherwise providing a rigid mounting of the modular pump platform 20 to the support structure. Specifically, the pump head module 260 and the pump motor module 360, when assembled, are detachably connected to the top ends of the vibration isolators 500A, and the tray 120 is detachably connected to the bottom ends thereof. The tray 120 is also detachably connected to the top ends of the feet 510, and the support surface may be detachably connected to the bottom ends of the feet 510. The sound-muffling enclosure 100 is disposed on and supported by feet 510 having bottom surfaces that constitute the bottom of the pump.

A natural frequency of the pump head 200 and the vibration isolators 500A is less than a lowest rotational frequency of components of the pump head 200 in cyclical motion. In the depicted embodiment, cyclical motion includes rotation, oscillation and orbiting motions.

The pump head 200, the pump motor 300, and the cooling fan 400 are juxtaposed with one another along a longitudinal axis of the assembled pump, i.e., in an axial direction of the assembled pump. Furthermore, the sound-muffling enclosure 100 has opposite ends in the axial direction. The ends of the sound-muffling enclosure 100 define an air inlet 100A and an air outlet 100B, respectively. The air outlet 100B may be defined by a grill. The cooling module 460 is detachably connected to the sound-muffling enclosure 100 over the air inlet 100A.

The pump head 200 includes a frame 210, a stationary plate scroll 220, an orbiting plate scroll 230, an eccentric drive mechanism 240, and fasteners fixing the stationary plate scroll 220 to the frame 210. The stationary plate scroll 220 comprises a stationary scroll blade 221, and the orbiting plate scroll 230 comprises an orbiting scroll blade 231. The stationary scroll blade 221 and the orbiting scroll blade 231 are nested with a clearance and predetermined relative angular positioning such that a pocket or pockets is/are delimited by and between the stationary and orbiting scroll blades. In this respect, side surfaces of the scroll blades 221 and 231 need not contact each other to seal the pocket(s). Rather, minute clearances between side surfaces of the scroll blades 221 and 231 may create a seal sufficient for forming a satisfactory pocket(s).

The eccentric drive mechanism 240 includes the input shaft 245 and bearings 246. In this example, the input shaft 245 is a crank shaft having a main portion 242 coupled to the output shaft 345 of the motor 300 in the pump motor module 360, via a universal coupler 322, so as to be rotated by the motor 300 about a longitudinal axis L, and a crank 243 having a central longitudinal axis that is offset in a radial direction from the longitudinal axis L. The bearings 246 comprise a plurality of sets of roller bearings, for example.

Generally, the orbiting plate scroll 230 is prevented from rotating about its own longitudinal axis by any of a number of means known in the art. For example, various means of preventing this rotation include a flexible metal bellows anchored at one end to the orbiting plate scroll 230 and at the other end to the frame 210, a number of crank assemblies with basically the same eccentricity as the driving crankshaft, or an Oldham coupling ring situated between the orbiting plate scroll 230 and the frame 210.

The inlet valve module 660, which includes isolation inlet valve 600 and valve wiring harness 661, is detachably connectable to the cowling 110 and the frame 210 of the pump head 200. As mentioned above, the isolation inlet valve 600 may be one of various types of isolation inlet valves, including a vacuum actuated isolation and vacuum-release valve, or an electrically actuated isolation valve that does not release vacuum in the pump. Alternatively, a straight through fitting (no isolation valve incorporated) may be incorporated. Any of the different types of isolation inlet valves 600 may be mounted to the mounting location on the frame 210 using the same connectors. In the depicted embodiment, the printed circuit board 165 includes electronic circuitry for operating the isolation inlet valve 600, which is electrically connected to the printed circuit board 165 via valve wiring harness 661 and a detachable plug. In alternative embodiments, the electronic circuitry may be included in the inlet valve module 660 or on a printed circuit board detachably connected to the tray 120 other than the printed circuit board 165.

Figure 5:
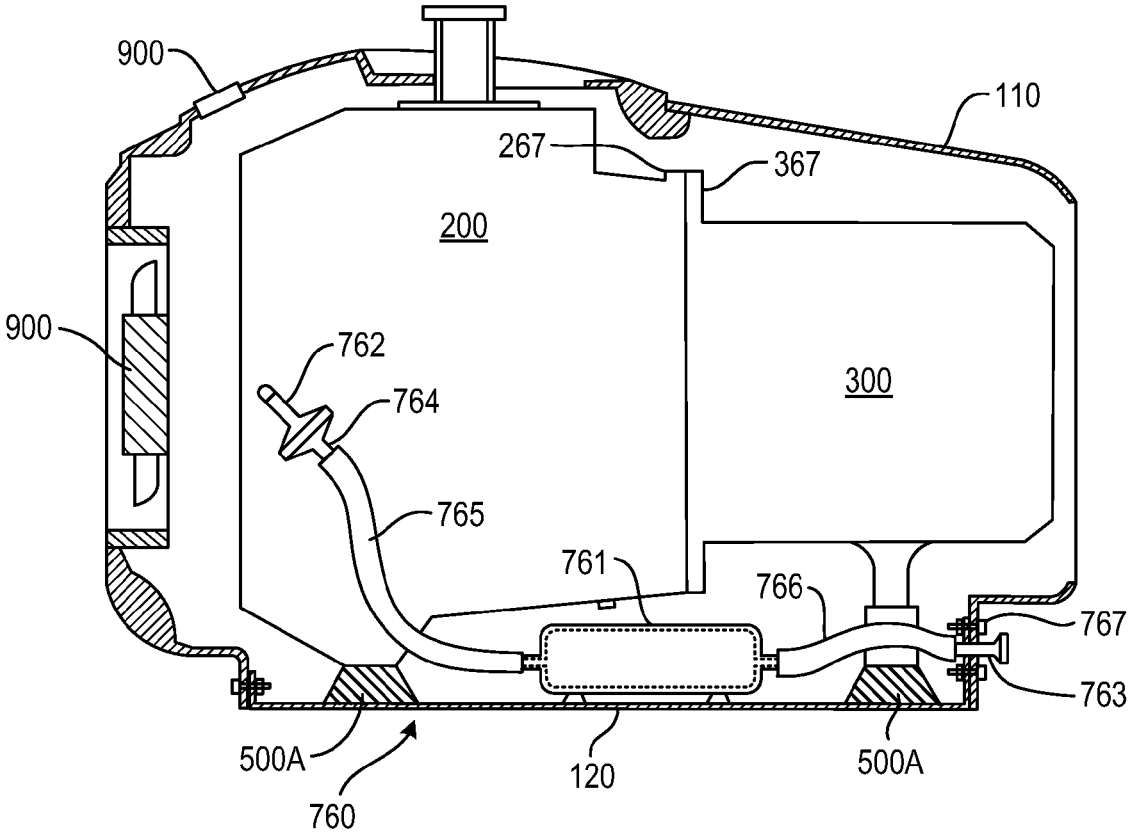
FIG. 5 is a schematic diagram of an exhaust muffler module, according to a representative embodiment.

The exhaust muffler module 760 is detachably connectable to the tray 120 and the pump head 200. FIG. 5 is a schematic diagram of the exhaust muffler module 760, according to a representative embodiment.

The exhaust muffler module 760 includes exhaust muffler 761, which is detachably connected to the tray 120 and configured to reduce exhaust noise produced by the pump head 200 and pump motor 300 during operation. The exhaust muffler 761 may be detachably connected to the tray 120 using screw or bolt fasteners (not shown), for example. The exhaust muffler module 760 further includes internal exhaust fitting 762, located within the pump head 200 to receive the pump exhaust, and external exhaust fitting 763, which passes through the sound-muffling enclosure 100 to provide an output for the pump exhaust external to the modular pump platform 20. The internal exhaust fitting 762 is detachably connected to a muffler fitting 764, which is connected to an intake end of the exhaust muffler 761 via (flexible) tubing 765. Similarly, an outlet end of the exhaust muffler 761 is connected to the external exhaust fitting 763 via (flexible) tubing 766. In the depicted embodiment, the external exhaust fitting 763 is detachably connected to the sound-muffling enclosure 100 by screws 767, although various alternative connections may be incorporated. If the exhaust muffler 761 is not desired, the internal exhaust fitting 762 may be routed to another exit (not shown) through the cowling 110, e.g., in closer proximity to the internal exhaust fitting 762, while the muffler fitting 764 and the external exhaust fitting 763 would not be required.

Referring to FIG. 2, the vacuum gauge module 860 includes vacuum gauge 800 and gauge wiring harness 861. The vacuum gauge 800 is detachably connectable to the frame 210 in an interior vacuum area of the pump head 200, enabling the vacuum gauge to monitor the vacuum level inside the pump head 200. For example, the vacuum gauge 800 may include a housing that is insertable into a hole through the frame 210 of the pump head 200, enabling access to the vacuum area. If no vacuum gauge module 860 is used, the hole for the vacuum gauge 800 may be sealed with a plug, for example. In the depicted embodiment, the printed circuit board 165 includes electronic circuitry for operating the vacuum gauge 800, which is electrically connected to the printed circuit board 165 via gauge wiring harness 861 and a detachable plug. In alternative embodiments, the electronic circuitry may be included in the vacuum gauge module 860 or on a printed circuit board detachably connected to the tray 120 other than the printed circuit board 165.

Figure 6A:
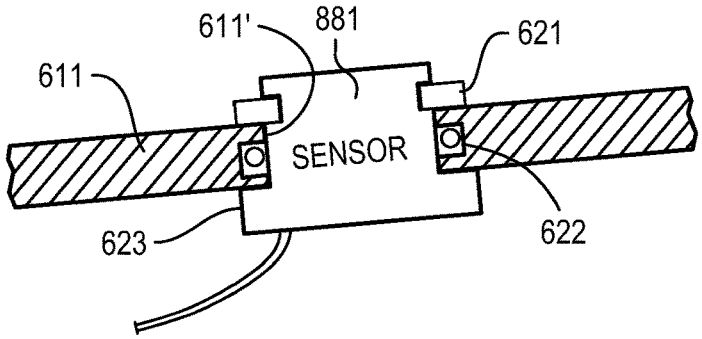
FIGS. 6A-6E are cross sectional views of sensors of vacuum gauge modules, according to representative embodiments.

FIGS. 6A to 6E depict illustrative configurations of a sensor in the vacuum gauge module 860 detachably connectable to the wall of the low-vacuum area of the pump head. FIG. 6A is a cross sectional view of vacuum gauge sensor 881 in pump wall 611, according to a representative embodiment. The pump wall 611 defines opening 611', in which the vacuum gauge sensor 881 is insertable. The vacuum gauge sensor 881 is held in place by retractable snap ring 621 at an outer surface and flanges 623 at an inner surface of the pump wall 611. O-ring 622 seals the opening through which the vacuum gauge sensor 881 is inserted.

Figure 6B:
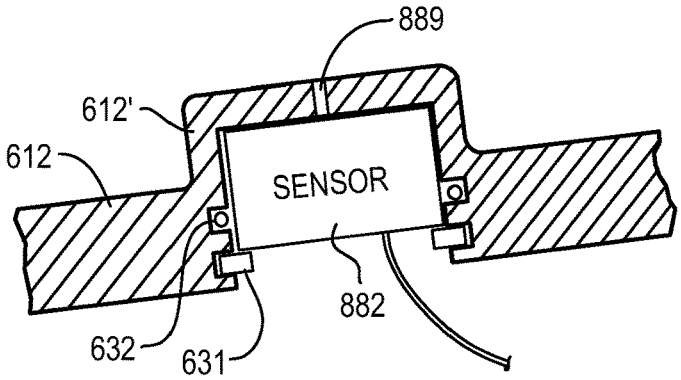

FIG. 6B is a cross sectional view of vacuum gauge sensor 882 in pump wall 612, according to a representative embodiment. The vacuum gauge sensor 882 is insertable into a pocket formed by an extended portion 612' of the pump wall 612. A port 889 is formed through the extended portion 612' to enable communication with the vacuum gauge sensor 882 from the outside. The vacuum gauge sensor 882 is held in place by retractable snap ring 631, and o-ring 632 seals the vacuum gauge sensor 882 within the pocket.

Figure 6C:
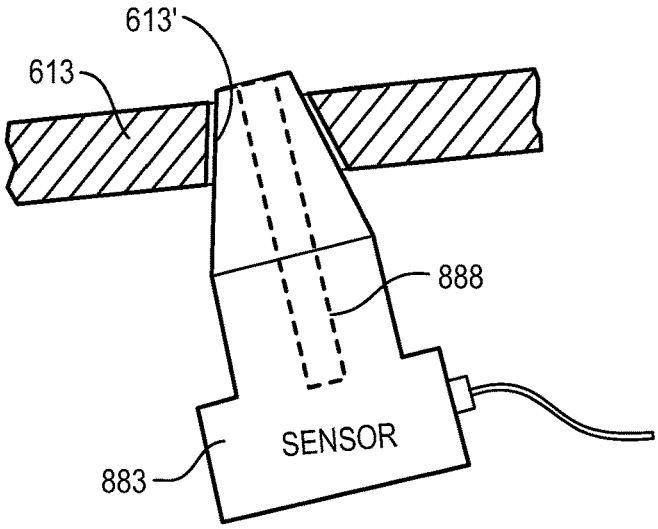

FIG. 6C is a cross sectional view of vacuum gauge sensor 883 in pump wall 613, according to a representative embodiment. The pump wall 613 defines tapered opening 613', which tapers to a smaller opening on the outer surface of the pump wall 613. The tapered opening 613' may include pipe threads. The vacuum gauge sensor 883 is insertable into tapered opening 613', engaging the pipe threads via a complementarily threaded outer surface. The vacuum gauge sensor 883 defines inner channel 888 which extends through the tapered opening 613' to enable communication with the vacuum gauge sensor 883 from the outside.

Figure 6D:
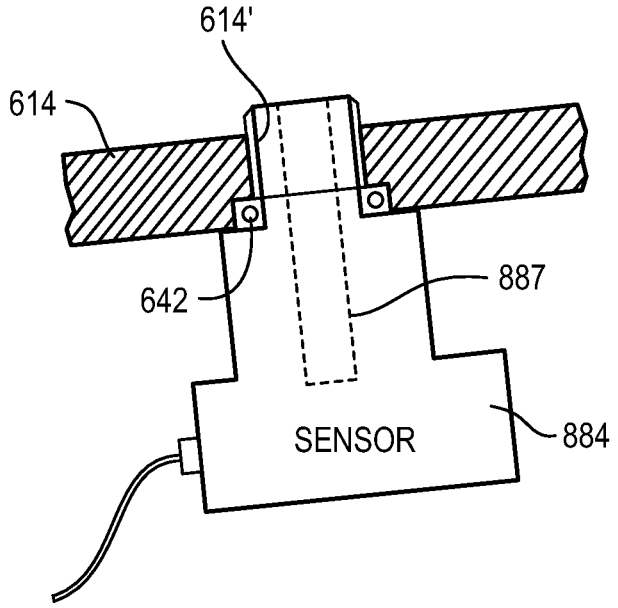

FIG. 6D is a cross sectional view of vacuum gauge sensor 884 in pump wall 614, according to a representative embodiment. The pump wall 614 defines threaded opening 614', which has substantially parallel sides. The threaded opening 614' may include machine screw threads. The vacuum gauge sensor 884 is insertable into the threaded opening 614', engaging the machine screw threads via a complementarily threaded outer surface. The vacuum gauge sensor 884 defines channel 887 which extends through the threaded opening 614' to enable communication with the sensor 884 from the outside. O-ring 642 seals the vacuum gauge sensor 884 at the inner side of the threaded opening 614'.

Figure 6E:
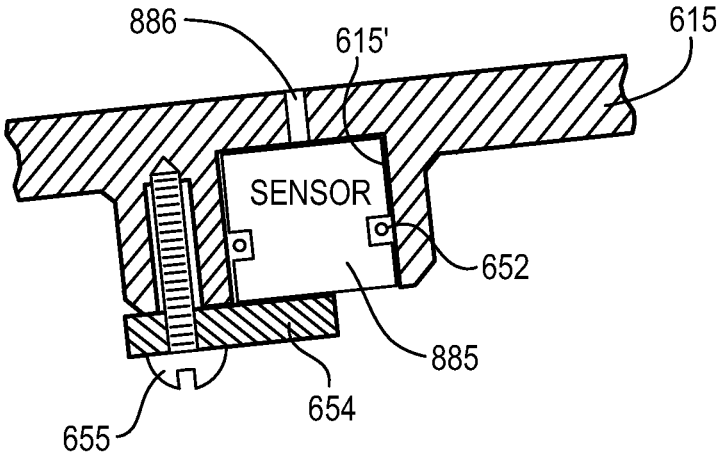

FIG. 6E is a cross sectional view of vacuum gauge sensor 885 in pump wall 615, according to a representative embodiment. The vacuum gauge sensor 885 is insertable into a pocket formed by an extended portion 615' of the pump wall 615. A port 886 is formed through the extended portion 615' to enable communication with the vacuum gauge sensor 885 from the outside. The vacuum gauge sensor 885 is held in place by a separate mechanical connector, depicted as retaining clip 654 held in place by retaining screw 655, for example. O-ring 652 seals the sensor 885 within the pocket.

In the various embodiments, variable configurations are possible by installing a solid plug within the respective openings (e.g., openings 611', 613', 614') when vacuum gauge function is not used, and replacing the solid plug with the respective vacuum gauge sensor (e.g., sensors 881, 883, 884) when the vacuum gauge function is desired. Solid plugs may likewise be used to plug ports (e.g., ports 889, 886), if needed, when the vacuum gauge function is not used. Alternatively, a small hole may be drilled at the time of configuring the pump for vacuum gauge usage, so when vacuum gauge usage is not desired, there is not a leak path of a solid plug. In this, the user may drill the hole or the drilling may be done in the factory, thus preventing the need to inventory two pump housings (with and without hole) while avoiding the risk of the potential leak path associated with a plug.

Referring to FIG. 2, the control panel module 960 includes a control panel 900 and control panel wiring harness 961. As mentioned above, the control panel 900 may be detachably connectable to the cowling 110 of the sound-muffling enclosure 100, e.g., using screw or bolt fasteners, or may be press-fit or snap-fit into pre-formed holes. The control panel 900 is essentially a user interface, and may include a display, a keyboard, a touch screen, and/or other features that enable control and monitoring of the modular pump platform 20 by a user. When no control panel 900 is used, a blank plate is fitted to the cowling 110 where the control panel 900 would be. In the depicted embodiment, the printed circuit board 165 includes electronic circuitry for operating the control panel 900, which is electrically connected to the printed circuit board 165 via control panel wiring harness 961 and a detachable plug. In alternative embodiments, the electronic circuitry may be included in the control panel module 960 or on a printed circuit board detachably connected to the tray 120 other than the printed circuit board 165.

Figure 7A:
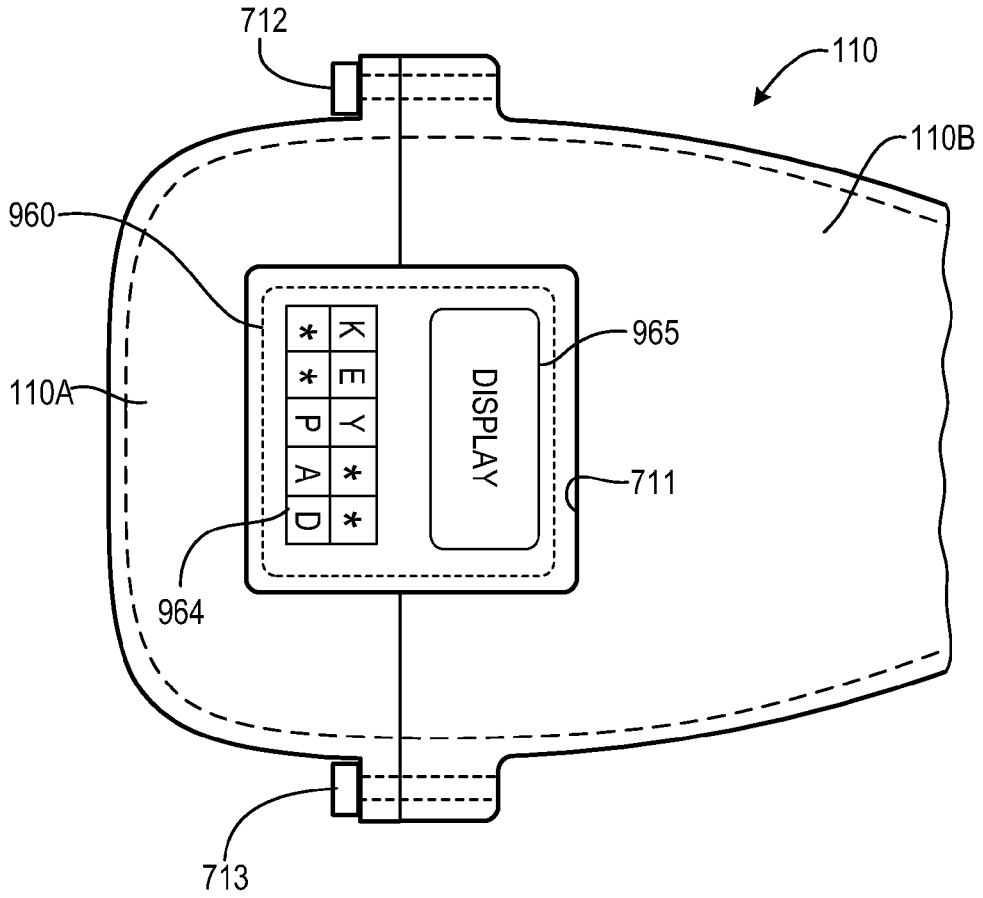
FIG. 7A is a top plan view of a control panel module held in place between separable sections of the cowling, according to a representative embodiment.
Figure 7B:
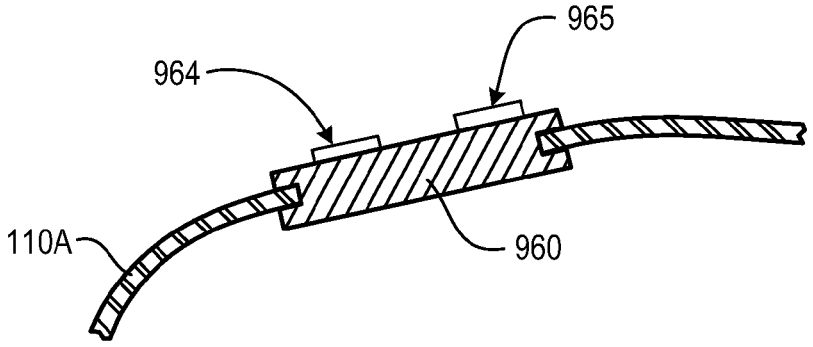
FIG. 7B is a cross sectional view of the control panel module held in place between separable sections of the cowling, according to a representative embodiment.

In an embodiment, the control panel module 960 may be held in place by two separable sections of the cowling 110. FIGS. 7A and 7B depict an illustrative configuration of a control panel module detachably connectable by separable sections of the cowling, according to a representative embodiment. FIG. 7A is a top plan view and FIG. 7B is a cross sectional view of the control panel module 960 held in place between separable sections 110A and 110B of the cowling 110. As mentioned above, the control panel module 960 includes user interfaces, such as keyboard 964 and display 965. The cowling 110 defines opening 711 to accommodate the control panel module 960 when the separable sections 110A and 110B are connected together by mechanical connectors, such as screws 712 and 713. The control panel module 960 also defines side slots 967 and 968, into which the separable sections 110A and 110B are insertable when in the assembled state, to secure the control panel module 960 in place.

Figure 8:
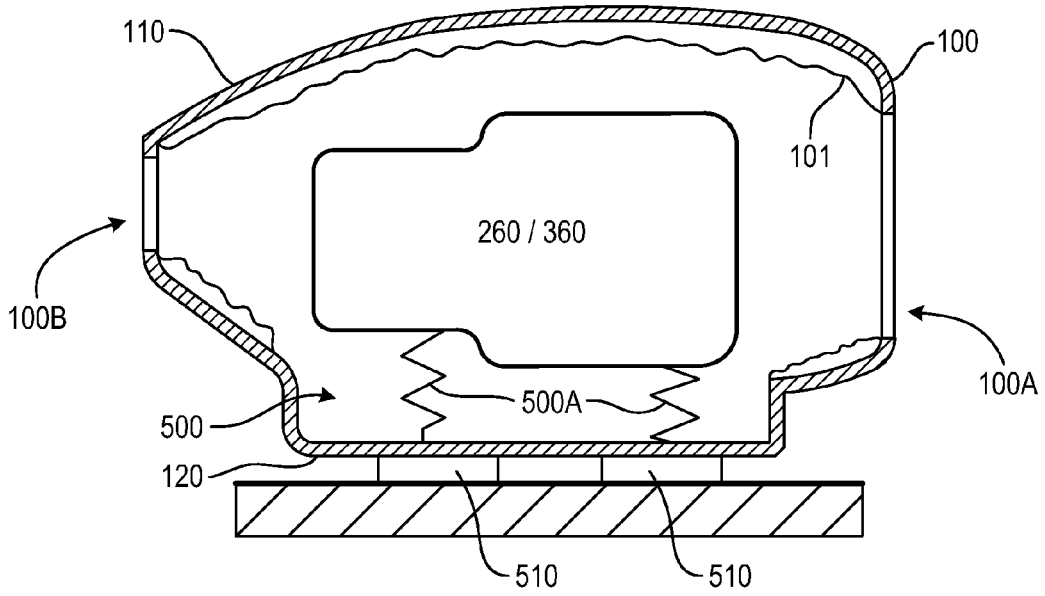
FIG. 8 is a schematic diagram of the modular pump platform in assembled form, according to a representative embodiment.

FIG. 8 is a schematic diagram of the modular pump platform in assembled form, according to a representative embodiment.

Referring to FIG. 8, the assembled pump head module 260 and pump motor module 360 are housed in the sound-muffling enclosure 100 and supported by the vibration isolation system 500, comprising a set of vibration isolators 500A each having top and bottom ends. The assembled pump head module 260 and pump motor module 360 are detachably connected to the vibration isolators 500A at the top ends thereof, and the sound-muffling enclosure 100 is detachably connected to the vibration isolators 500A at the bottom ends thereof. The sound-muffling enclosure 100 is disposed on and supported by feet 510 having bottom surfaces that constitute the bottom of the modular pump platform.

In an embodiment, the assembled pump head module 260 and pump motor module 360 are attached to the sound-muffling enclosure 100 only through the vibration isolators 500A so as to be movable (due to the elasticity of the vibration isolators) relative to the sound-muffling enclosure 100. Therefore, the vibration isolation system 500 isolates the sound-muffling enclosure 100 from vibrations transmitted from the assembled pump head module 260 and pump motor module 360. Because the sound-muffling enclosure 100 constitutes the exterior of the modular pump platform 20, these vibrations are not imparted to the exterior of the scroll pump. Hence, the noise produced by the rotary components of the pump head module 260 and pump motor module 360 is muffled.

To increase this effect, the sound-muffling enclosure 100 may be formed in part or in whole of a known type of sound-absorbing material. Alternatively, sound-absorbing material 101 may be attached to inside surfaces of the sound-muffling enclosure 100.

The assembled pump head module 260 and pump motor module 360, as a mass, are supported on the vibration isolators 500A as springs. Thus, in this respect, the vibration isolators 500A should be designed to isolate the vibration of the mass from the support structure on which the assembled pump head module 260 and pump motor module 360 rest. Generally, isolation may be achieved when the natural frequency of the mass-spring system is lower than the vibration frequency. For example, the lowest vibration frequency of significance should be first order (or 1×) the rotational frequency of the shaft, which is approximately 30 Hz for a one phase electric motor operated on 60 Hz mains. Specifically, the spring constant k of the vibration isolators 500A should be such that the natural frequency of the mass supported by the springs ($\sqrt{k/m}$) is substantially less than lowest frequency of the vibrations that are expected to be produced by the apparatus. In the case of apparatus such as a scroll pump, the components that produce vibrations of the lowest frequency are the rotary components, i.e., the lowest frequency of vibrations typically corresponds to the lowest frequency of rotation w of the rotary components which in this case is the frequency of rotation of the pump motor 300. Thus, the vibration isolation system 500 is configured such that the natural frequency of vibration of the mass-spring system consisting of the assembled pump head module 260 and pump motor module 360, together with the isolating mounts 500A, is less than the rotational frequency of the motor 300.

In this case, the vibration isolators 500A will be effective in reducing the transmission of vibrations produced by the mass. However, although the lowest frequency of vibrations (e.g., ~30 Hz) produced by the rotary components during normal operation of the pump falls below or near the range of audible frequencies, the operation gives rise to harmonics within the range of audible frequencies. Therefore, the vibration isolators 500A may do little to prevent airborne noise produced by the vibrating mass (the assembled pump head module 260 and pump motor module 360).

As is clear from the description above, the sound-muffling enclosure 100 surrounds the vibrating mass. Furthermore, the sound-muffling enclosure 100 remains stationary or will at most vibrate to a much lower degree than the mass because the sound-muffling enclosure 100 is attached to the vibration isolators 500A at what amounts to the stationary end of the springs constituted by the vibration isolators 500A. Thus, the sound-muffling enclosure 100 will not vibrate to produce any airborne sound itself, and will block or cause the sound waves produced by the mass (the assembled pump head module 260 and pump motor module 360) to attenuate them, thereby muffling the sound produced by the mass. An example of vibration isolation design is described in U.S. Patent Application Pub. No. US 2014/0271242, titled "Vibration/Noise Management in a Scroll Compressor," which is hereby incorporated by reference.

In this embodiment, the sound-muffling enclosure 100 comprises the cowling 110 and the tray 120. The vibration isolators 500A are detachably connected to the top of the tray 120, and the assembled pump head module 260 and pump motor module 360 are supported by the tray 120 atop the vibration isolators 500A. The cowling 110 is detachably connected to the tray 120 at locations spaced from the vibration isolators 500A. The cowling 110 may be made up of several parts to facilitate its ability to be secured to and removed from the tray 120.

A locking system for use in managing the vibrations and/or facilitating the transport of the modular pump platform in a safe way also may be incorporated. An example of a locking system also is described in above-referenced U.S. Patent Application Pub. No. US 2014/0271242.

According to the various embodiments, a vacuum pump of almost any configuration to meet many varying application specific requirements can be easily assembled by combining the appropriate interconnecting modules. Also, vibration isolators may be used between the tray and the pumping mechanism, so that the pump may be moved and handled as a single assembly, without requiring customer installation of the vibration isolators, or risking damage to the isolators.

Embodiments of the inventive concept and examples thereof have been described above in detail. The inventive concept may, however, be embodied in many different forms and should not be construed as being limited to the embodiments described above. Rather, these embodiments were described so that this disclosure is thorough and complete, and fully conveys the inventive concept to those skilled in the art. Thus, the spirit and scope of the inventive concept is not limited by the embodiment and examples described above but by the following claims.

What is claimed:

1. A modular scroll pump platform, comprising:

a pump head module comprising a pump head having a stationary portion and a rotary portion connected to a crank shaft, wherein the stationary portion of the pump head comprises a stationary plate scroll fixed in the pump head, and the rotary portion of the pump head comprises an orbiting plate scroll interfacing with the stationary plate scroll to pump air through the pump head;

a pump motor module comprising a pump motor having a rotary output with a removable coupling removably coupled to the crank shaft of the pump head, the pump motor module being one of a plurality of different pump motor modules having different respective pump motors, the different pump motor modules configured to be detachably connected to the crank shaft of the pump head module;

a same type of connector for interconnecting the respective different pump motor modules to the crank shaft of the pump head module;

an inlet valve module comprising an isolation inlet valve detachably connectable to an air inlet of the pump head module, the isolation inlet valve comprising at least one of an air operated inlet valve or a fully sealed inlet valve;

a fan configured to be driven independently of the pump motor;

an electronics module comprising an electronic control circuit configured to control operation of the pump motor, the electronic control circuit being one of a plurality of types of electronic control circuits corresponding to the plurality of different pump motors;

a sound-muffling enclosure comprising a separable cowling and a separable tray to which each of the pump head module, the pump motor module and the electronics module corresponding to the pump motor module is detachably connected, the sound-muffling enclosure being configured to house the pump head module, the pump motor module and the electronics module, wherein the cowling is separable from the tray; and a vibration isolation system comprising a set of elastic vibration isolators having top ends and bottom ends, respectively, wherein the top ends of the vibration isolators are detachably connectable to one of the pump head module or the pump motor module, and the bottom ends of the vibration isolators are detachably connectable to the separable tray, and wherein the vibration isolation system isolates the sound-muffling enclosure from vibrations transmitted from at least one of the pump head module or the pump motor module, and wherein, by use of the same type of connector, the pump motor module is interchangeable with the different pump motor modules.

2. The modular pump platform of claim 1, wherein the different pump motors comprise at least two of a single phase motor, an inverter controlled variable speed three phase motor, a brushless DC motor, a brushed DC motor, an air driven motor, and a hydraulically driven motor.

3. The modular pump platform of claim 2, wherein the plurality of different pump motors operate at different voltages.

4. The modular pump platform of claim 1, further comprising:

a vacuum gauge module comprising a vacuum gauge detachably connectable to the pump head module.

5. The modular pump platform of claim 4, wherein the vacuum gauge module further comprises a vacuum gauge sensor insertable into an opening or pocket defined in a pump wall, and configured to communicate with outside the pump head module via the opening or a port connected to the pocket.

6. The modular pump platform of claim 5, wherein the vacuum gauge sensor comprises pipe threads or machine screw threads on an outer surface, configured to engage complementary pipe threads or machine screw threads on an inner surface of the opening.

7. The modular pump platform of claim 1, further comprising:

a cooling module comprising the fan, and detachably connectable to the separable cowling.

8. The modular pump platform of claim 1, further comprising:

an exhaust muffler module comprising an exhaust muffler detachably connectable to an air outlet of the pump motor module.

9. The modular pump platform of claim 1, wherein the electronic control circuit in the electronics module comprises a single printed circuit board comprising circuitry for controlling the pump motor and a wiring harness.

10. The modular pump platform of claim 9, wherein the separable tray comprises a plurality of locating pins and a plurality of flexible snap fit retainers extending from a top surface of the separable tray, and wherein the plurality of locating pins are configured to communicate with a corresponding plurality of holes defined by the printed circuit board, and the plurality of flexible snap fit retainers are configured to retain the printed circuit board, to detachably connect the printed circuit board to the separable tray in an assembled state.

11. The modular pump platform of claim 1, wherein the pump head module further comprises a first end of a universal coupler attached to the crank shaft, and the pump motor module further comprises a second end of the universal coupler attached to the rotary output, the first and second ends of the universal coupler being configured to interconnect.

12. The modular pump platform of claim 1, wherein the pump head module is connectable to the pump motor module using a flange joint and at least one pilot feature for alignment.

13. The modular pump platform of claim 1, wherein the pump motor module is detachably connected to the pump head module using a connection that can be disengaged by hand.

14. The modular pump platform of claim 1, further comprising:

a control panel module, comprising a user interface, detachably connectable to the separable cowling.

15. The modular pump platform of claim 14, wherein the separable cowling comprises two separable sections that define an opening configured to accommodate the control panel module when the separable sections are connected, and wherein the control panel module defines side slots into which the separable sections are insertable when connected.

16. A modular pump platform, comprising:

a sound-muffling enclosure comprising a separable cowling and a separable tray, wherein the cowling is separable from the tray;

a pump head module detachably connected to the separable tray and housed in the sound-muffling enclosure;

a pump motor module detachably connected to the pump head module with a removable coupling and to the separable tray, the pump motor module housed in the sound-muffling enclosure for operating the pump head module;

the pump motor module being one of a plurality of different pump motor modules having different respective pump motors, the different pump motor modules configured to be detachably connected to a crank shaft of the pump head module;

a same type of connector for interconnecting the different pump motor modules to the crank shaft of the pump head module;

an inlet valve module comprising an isolation inlet valve detachably connectable to an air inlet of the pump head module, the isolation inlet valve comprising at least one of an air operated inlet valve or a fully sealed inlet valve;

an electronics module detachably connected to the separable tray and the pump motor module, the electronics module housed in the sound-muffling enclosure and configured to include a plurality of different electronic control circuits corresponding to the plurality of different pump motors; and a vibration isolation system comprising a set of elastic vibration isolators having top ends and bottom ends, respectively, wherein the top ends of the vibration isolators are detachably connectable to one of the pump head module and the pump motor module, and the bottom ends of the vibration isolators are detachably connectable to the separable tray, wherein, by use of the same type of connector, the pump motor module is interchangeable with the different pump motor modules.

* * * * *